US005325822A

United States Patent [19]

Fernandez

[11] Patent Number: 5,325,822

[45] Date of Patent: Jul. 5, 1994

[54] ELECTRTIC, MODULAR TANKLESS FLUIDS HEATER

[76] Inventor: Guillermo N. Fernandez, 3107 Timberlark, Kingwood, Tex. 77339

[21] Appl. No.: 780,650

[22] Filed: Oct. 22, 1991

Related U.S. Application Data

[63] Continuation-in-part of Ser. No. 780,797, Oct. 22, 1991.

[51] Int. Cl.[5] ..... F22B 5/00

[52] U.S. Cl. ..... 122/13.2; 122/448.3; 392/451; 392/491; 219/486

[58] Field of Search ..... 122/14, 19, 448.3, 13.2, 122/DIG. 13, 4 A; 392/450, 451, 491, 492; 219/486

[56] References Cited

U.S. PATENT DOCUMENTS

| | | | |
|---|---|---|---|
| 3,715,566 | 2/1973 | Wasson | 392/457 |
| 4,116,016 | 9/1978 | Roup et al. | 122/DIG. 13 |
| 4,324,207 | 4/1982 | Leuthard | 122/448.3 |
| 4,534,321 | 8/1985 | Rydborn | 122/448.3 |
| 4,604,515 | 8/1986 | Davidson | 219/486 X |
| 4,637,349 | 1/1987 | Robinson | 122/448.3 |
| 4,825,043 | 4/1989 | Knauss | 392/482 |

*Primary Examiner*—Edward G. Favors
*Attorney, Agent, or Firm*—Bernard A. Reiter

[57] ABSTRACT

A tankless, flow-through electric water heater whose housing is designed for modular application, where serially connected modules define the path of the fluid being heated, in this case water, through the heater from inlet to final outlet. Each module contains two separate chambers and each chamber is provided with an electric immersion type heating element. The first and last chambers will also have a temperature sensor which will signal an electronic temperature control system. The temperature sensor in the first and last chambers provides signal inputs to energize each heating element of each chamber for a period of time proportional to the temperature difference between first chamber and the desired set leaving temperature of the water, which is set by an adjustable temperature controller (potentiometer), included in this control system. This control system also has a minimum setting point for a "no flow" condition or for the prevention of water freezing, where extreme weather conditions exist.

13 Claims, 7 Drawing Sheets

ELECTRTIC, MODULAR TANKLESS FLUIDS HEATER

This application is a continuation-in-part of my U.S. application Ser. No. 07/780,797, filed on Oct. 22, 1991, and also entitled Electric, Modular Tankless Fluids Heater.

FIELD OF INVENTION

The present invention relates to an apparatus that heats water or other liquids without the need of a storage tank but rather heats instantaneously a continuous flow of the fluid when heating elements are energized. For simplicity purposes, I will use water as the fluid to be heated, since water is one of the most commonly used fluids to be heated. Water heaters are well known. They include, but are not limited to, a storage tank, a thermostat, a heat source and inlet and outlet ports. The water in the tank is heated until it reaches the desired temperature which is preset through the thermostat.

BACKGROUND OF THE INVENTION

Normally, the tank is of fair size and it is a slow process to heat all the water in the tank to a preset temperature. The water is not heated at the same rate that it is used, therefore, the rate of recovery for the water to reach again the desired temperature, is relatively slow. The storage tank provides a reserve of hot water which normally supplies short term needs. If more hot water is used than the amount of water stored in the tank, the temperature of the water drastically drops due to the heater's low heat recovery rate, then the user must stop the flow and wait for the heater to heat the water back to the desired temperature. This type of heater is usually installed in an environment where the ambient temperature is lower than that of the temperature of the water in the tank. Thus, the loss of heat to the ambient air causes the heater to turn on and continuously reheat the water in the tank in order to maintain the desired water temperature. The energy used to reheat the water is wasted and no benefit is derived from it.

Heretofore, numerous attempts have been made to reduce the heat loss and wasted energy. This includes obvious solutions such as insulation for the water heaters. This helped to reduce the heat loss to some extent but was not completely effective and adversely increased the size of the heaters known in the prior art. Another solution to this problem has been the introduction of a variety of tankless water heaters. These heaters reduced to some extent the problem of energy loss, but were characterized by insufficient volume of hot water and space problems. Obviously, even these tankless type water heaters brought on a new variety of problems. Most units available were of small capacity and had severely limited flow rates and temperature rise capability. The larger units attempted maximum flow rates and temperature rise but required excessively large minimum flow rates to energize the systems. Most depended on conventional flow detection devices to energize the heaters. Other shortcomings included were poor maintenance capability, inability to replace individually worn parts without substantial component replacement, and the inability to get rid of entrapped air or gases in the system. This was at times due to use of water wells as a source of water supply and to pressurized pump systems (i.e., to get rid of air or gases).

SUMMARY OF THE INVENTION

The present invention is directed to a tankless water heater characterized by a high hot water flow capability that is greater than any known in the prior art. It also solves the problems of maintenance accessibility and capability of capacity growth. It has also solved one of the principle problems of conventional storage type water heaters, namely the high energy loss due to having to constantly reheat the water. Similarly, the heat loss to the atmosphere due to storing the water is alleviated.

In the present invention, there is shown, for example, the heater comprising a module with two inner chambers, each chamber containing a heating element. Several modules can be attached to each other to form a heater of selective size that can provide a great variety of flow and temperature rise requirements. For the purpose of example, the fluid chosen for explanation here is water. It is the fluid to be heated, but one shall know that this heater is designed to be used to heat other fluids other than water.

Cold water enters the heater at an inlet port and then flows through the module containing the two chambers or through a series of modules sequentially installed in a manner defining the flow path of the water. The water leaves through an outlet port. The heating elements are contained within each chamber of each module. If the temperature of the water leaving the module's second chamber is lower than the desired preset temperature, the heating element will be energized to raise the departing water temperature to the desired preset temperature. Generally, this is true with respect to the departing chamber of each module. The number of heating elements energized is made proportional to a number of factors including the rate of flow, the entering temperature of the water, the desired leaving temperature of the water and the capacity of the heating elements. The lower the rate of flow or temperature rise required, the fewer the number of heating elements that are energized and the shorter the period of time that the heating elements must remain energized.

In order to achieve the aforementioned operating criterion, a heating element is located in each chamber of each module. Also, a temperature sensing device is in the first and last chambers of a heater which will energize or de-energize each element to maintain the desired water leaving temperature. The heater will include the necessary number of chambers and heating elements to provide the total heating capacity required based on the maximum desired temperature rise and rate of flow, allowing the heater to maintain a continuous rate of flow at the desired water leaving temperature for an indefinite period of time.

It will be recognized that low flow rates are possible with this heater design without an over-heating condition due to the staged design of energizing the heating elements. The unit is compact in size due to the absence of a storage tank. The interior surface of the chambers may be coated with an epoxy coating. This coating is used to reduce the possibility of deterioration of the metallic walls of the chamber. It also provides a smooth, nonporous finish in the interior chamber surface which reduces the amount of mineral deposits and other solid matter that will adhere to the interior walls of the chambers. The coating will also help ease the maintenance by keeping the chambers clean, thus also increasing the life of the heater.

The module's exterior surface may be coated with a liquid ceramic coating. It is capable of providing an equivalent insulating value of an R-7 rating, more or less. Even though the heat loss in this heater is very small due to its size, the ceramic coating will further reduce the heat loss to the atmosphere. The ceramic coating also renders the exterior surfaces of the modules impermeable.

One of the chambers in each module may also have a port located in an upper area so that an automatic air float vent may be installed to allow entrapped air or gases in the system to leave without having to manually do it. An electrical circuit which is part of the electronic control system prevents the electric system from being energized without the presence of water in all chambers. This feature in the electronic control system, prevents the all too common problem of "dry-firing" a heater and thus burning the heating elements and possibly causing extensive damage, if not destruction, to the heater, the electrical system and adjacent property. These "dry firing" sensors are installed in the first and last chambers of each water heater, in order to insure that water is present in all chambers. The preceding features and advantages of the invention will be more clearly understood upon a careful reading of the following claims, specification, and drawings wherein like numerals denote like parts in the various views and wherein:

DESCRIPTION OF PREFERRED EMBODIMENT

Figure 1:
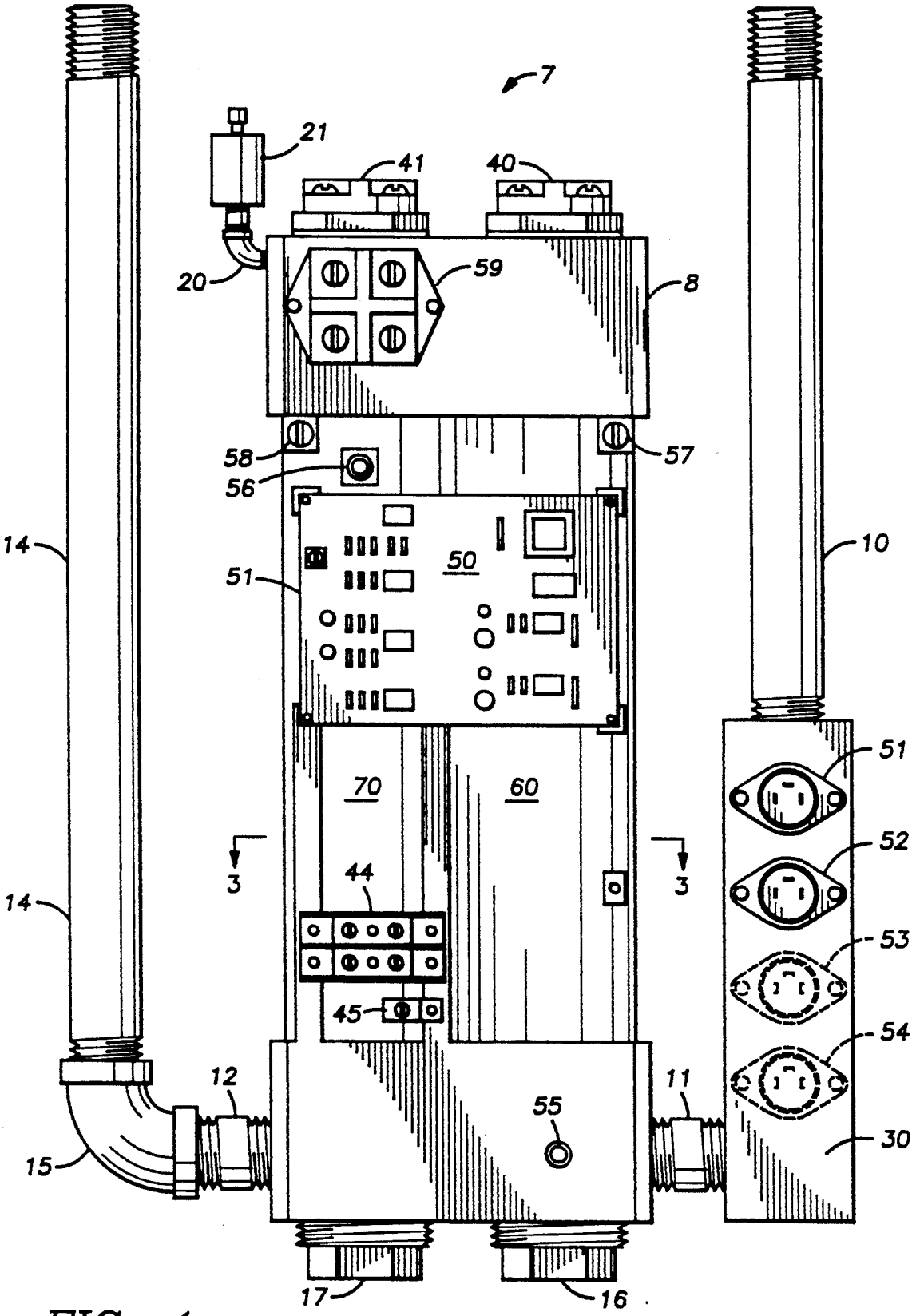
FIG. 1 is a front view of heater.
Figure 7:
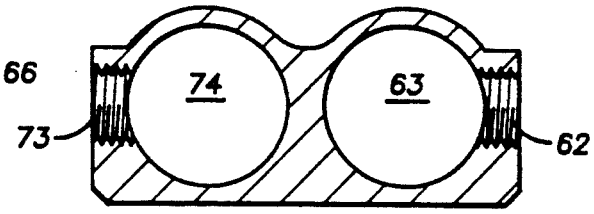
FIG. 7 is a section D—D view through FIG. 2.
Figure 8:
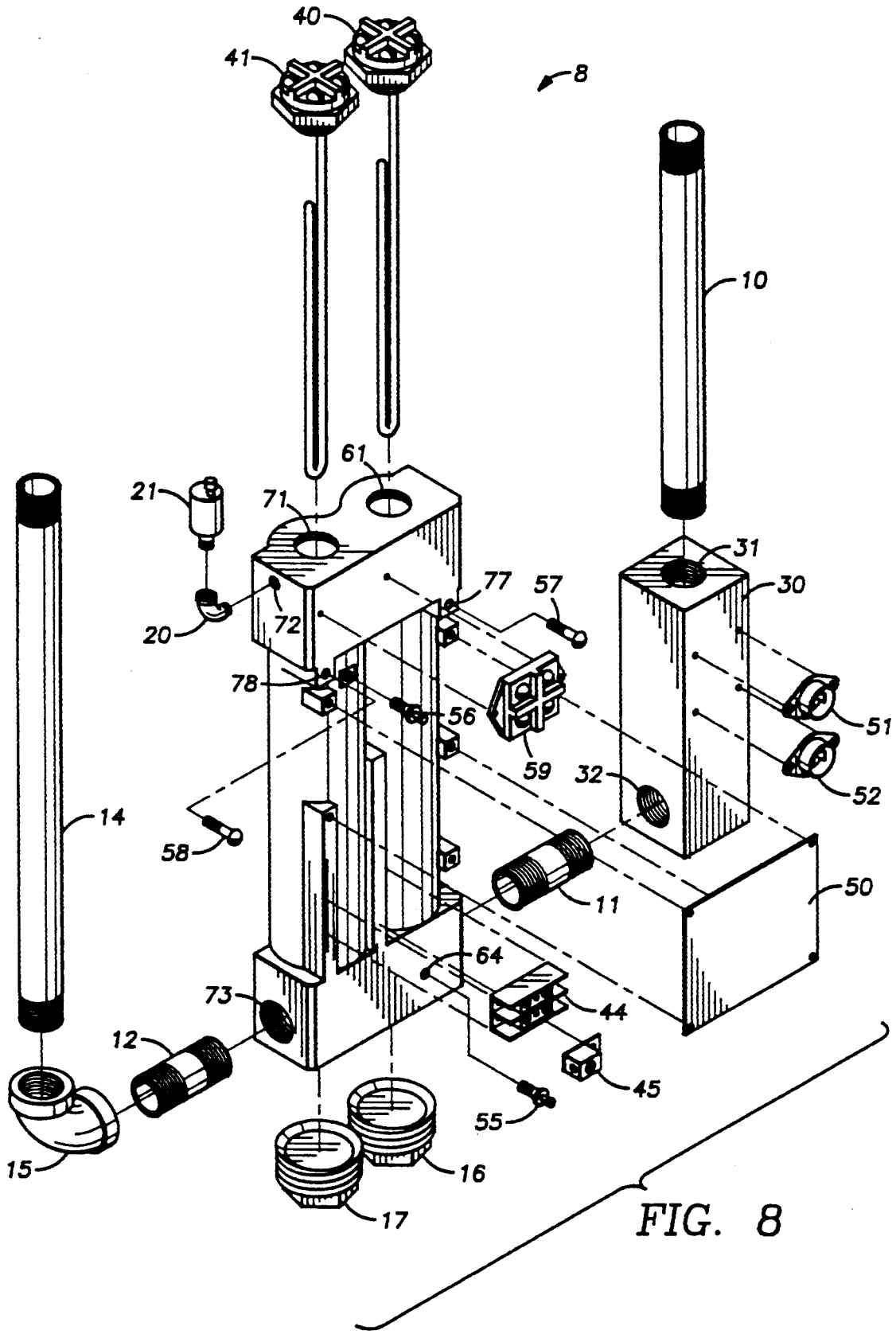
FIG. 8 is an exploded perspective view of heater (one module ).
Figure 11:
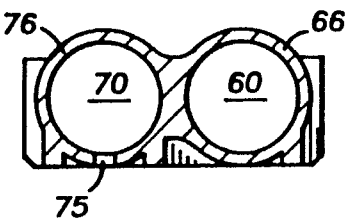
FIG. 11 is a section E—E view through FIG. 9.
Figure 10:
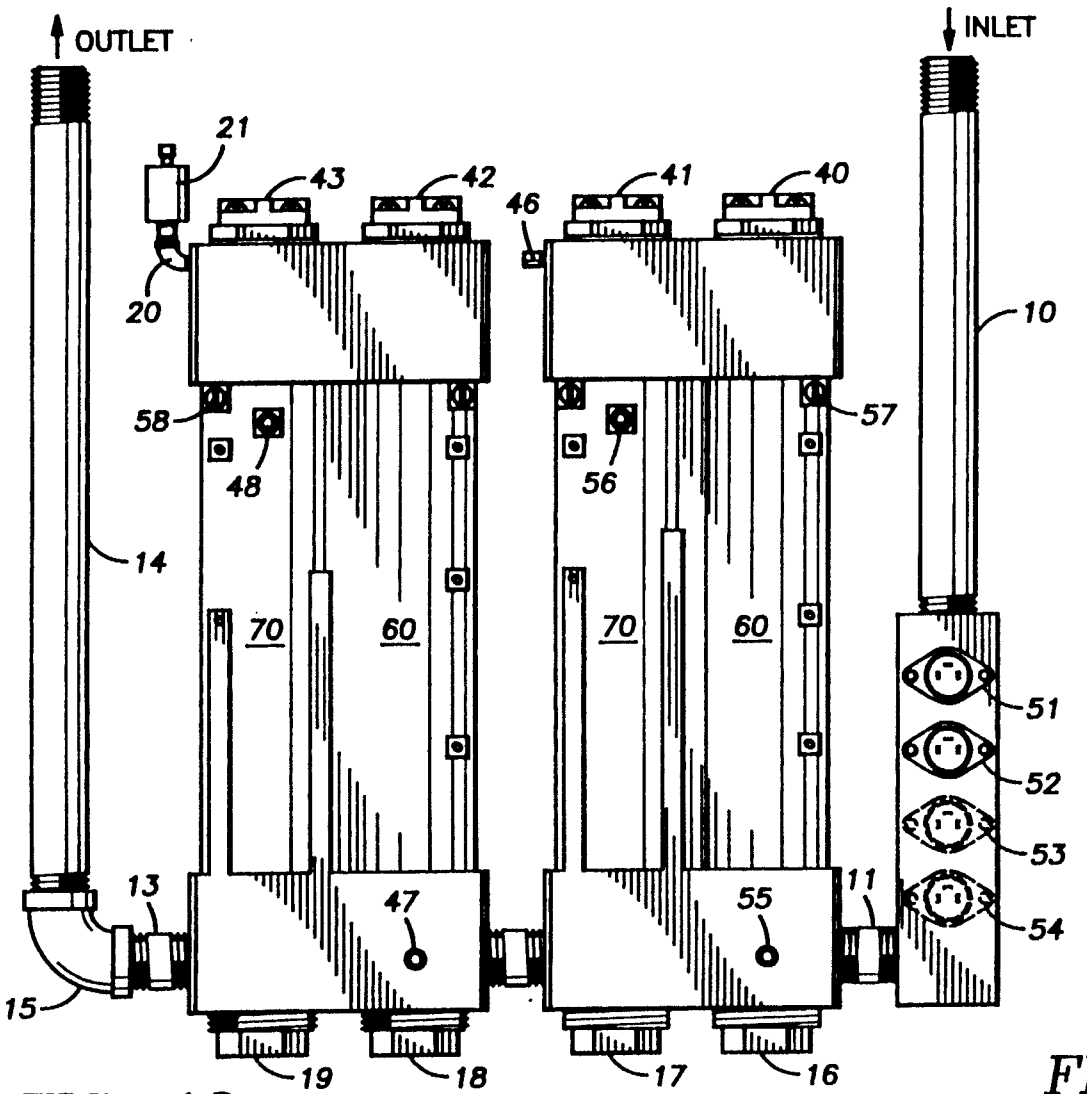
FIG. 10 is a front view of heater in a modular configuration.

Referring to FIG. 1, FIG. 8 and FIG. 10, there is shown a water heater 7 exemplary of the present invention. The heater 7 contains a heater inlet pipe 10, a heater outlet pipe 14, communicating with a module 8 which contains a first chamber 60 and a second chamber 70. Each contain a heating element 40 and 41, respectively ( FIG. 8 ). A multiple module ( 2 ) heater configuration is shown in FIG. 10. Referring to FIG. 1, FIG. 8 and FIG. 10, inlet pipe 10 is attached to triac mounting section 30 which is perforated inside to allow the flow of water through it. This triac mounting section 30 is attached to a pipe nipple 11 which in turn is attached to module 8 at port 62 in chamber 60 (see FIG. 2, FIG. 7, and FIG. 11 ). The above connections may be made through threaded connections.

Figure 2:
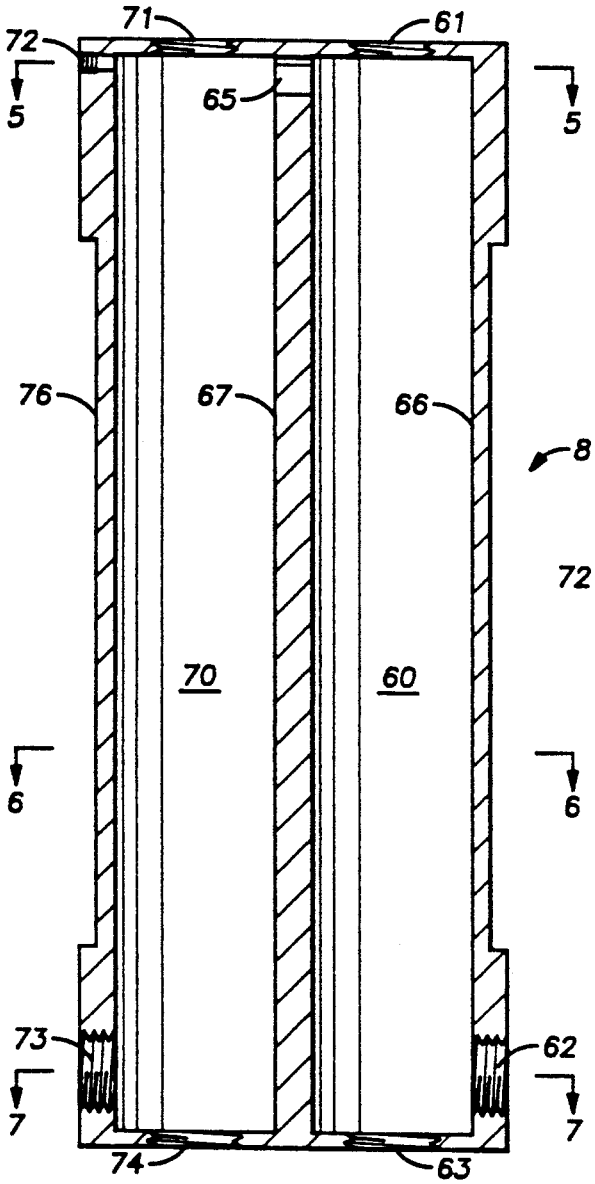
FIG. 2 is a cross section of front elevation of heater.
Figure 4:
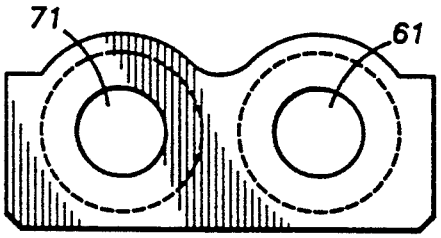
FIG. 4 is a top view of FIG. 2.
Figure 3:
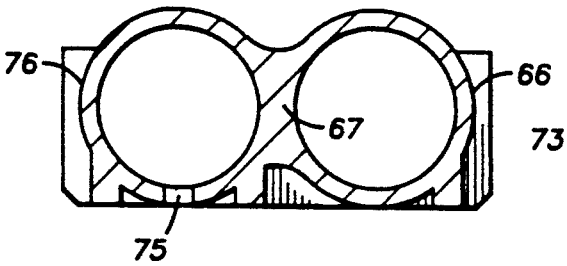
FIG. 3 is a section A—A through FIG. 1.

Referring to FIGS. 2, 3,, 6 and 11, chamber 60 is encased by chamber walls 66 and 67. At the upper area of chamber wall 67 is a connecting port 65 which allows the flow of water from chamber 60 to chamber 70, which itself is encased by chamber walls 67 and 76. Outlet pipe 14 (FIG. 1), attached to elbow 15, which is attached to pipe nipple 12. This, in turn, is attached to module 8 at outlet port 73 in chamber 70. All of the above may be connected through threaded connections. It is thus seen that the water flows from inlet pipe 10 through module or modules 8 and out through outlet pipe 14.

Figure 9:
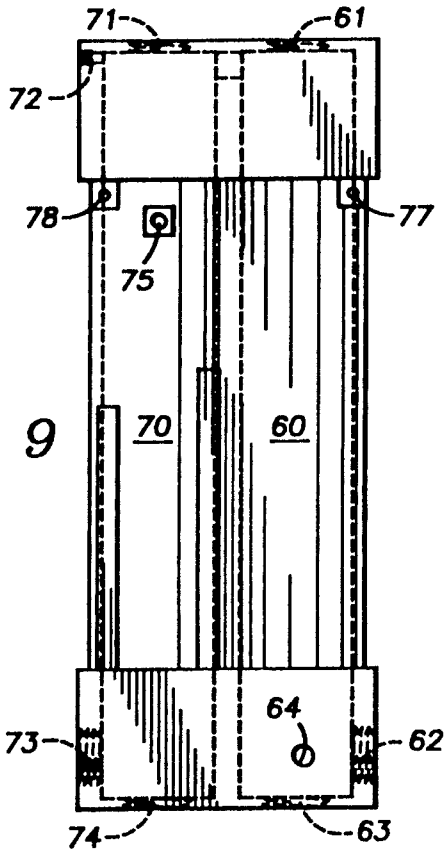
FIG. 9 is a front view of typical module.

Now, referring to FIGS. 2, 7, and 9, there is shown, at the lower area of chamber 60 and chamber 70, openings 63 and 64, respectively. These openings exist for the purpose of providing access to remove any accumulated particulate matter in the chambers and also for draining the chambers. These openings 63 and 74 are closed when the heater is on by means of threaded plugs 16 and 17 attached to chamber 60 and chamber 70, respectively (See FIG. 1). Referring now to FIGS. 2, 4, 8 and 9, heating element 40 and heating element 41 extend down through openings 61 and 71 located at upper area of chamber 60 and chamber 70, respectively. These may connect by means of threaded connections. Although the preferred embodiment uses electric resistive type heating elements as the heating means, other means are possible such as, for example, liquified petroleum, natural gas, heating oil, or any other sources of heat.

In FIGS. 1, 8, and 10, there is shown a relief vent 21 tied to an elbow 20 which in turn is connected to module 8 at chamber 70 through opening port 72; or in the case of double module (FIG. 10), at chamber 90 through same port. The automatic relief air float vent 21 in chamber 70 is for the purpose of releasing to the atmosphere any entrapped air or gases in the system.

Figure 5:
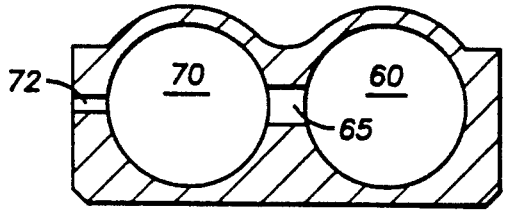
FIG. 5 is a section B—B view through FIG. 2.
Figure 6:
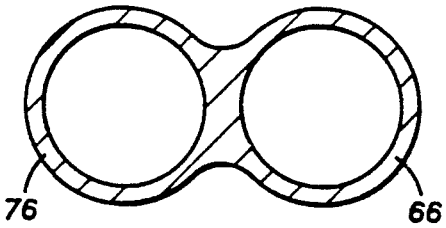
FIG. 6 is a section C—C view through FIG. 2.

In operation, the cold fluid enters heater 7 through inlet pipe 10 and flows through triac mounting section 30. This section serves at least two main purposes. First, it provides an area in which to mount triacs 51, 52, 53 and 54, and second, the flow of cold water through the triac mounting section 30 advantageously cools down the triacs while heater 7 is in operation. This markedly reduces wear and enhances the life of the unit. A heat sink compound may be installed between the surface of the triac mounting section 30 and the triacs 51, 52, 53 and 54. The cold water then enters chamber 60 at inlet port 62 in module 8 (see FIGS. 2, 7 and 9) and travels past heating element 40. The water is then heated at this point when heater 7 is energized. After the water is heated by the heating element 40, it flows to chamber 70 through connecting port 65 (FIGS. 2 and 5). The dimensions of the connecting port 65 is varied depending on flow rate requirements.

Referring to FIGS. 1 and 10, it is seen that when water leaves chamber 60 and enters chamber 70, it is heated by heating element 41, if additional heat is required. The same procedure follows through chamber 80 and chamber 90 in the multiple module model with heating elements 42 and 43, respectively (see FIG. 10). The actual number of modules and/or chambers and heating elements is variable as initially explained and depending on the rate of flow required, the temperature rise and capacity of the heating elements. This is accomplished expeditiously by the modular design. In any event, the water finally leaves the last chamber and exits the heater 7 through the outlet pipe 14.

Referring to FIG. 10, a temperature sensor 55 and 56 located in chambers 60, and 90 respectively is shown. Even if only two modules 8 are shown, there is illustrated the capability of multiple installation of modules 8 for different capacity heaters. Each additional module 8 connects to the preceding module by means of pipe nipple 13. Through use of temperature sensor 55 (FIGS. 8 and 9) connected to chamber 60 through opening 64 and protrudes into chamber one 60 for sensing the temperature of the water flowing in this chamber.

Temperature sensor 56 is connected to chamber 90 through opening 75 and protrudes into the interior of that chamber for sensing the temperature of the water flowing through this chamber. In FIGS. 1, 8 and 10, there is shown terminal block 44 and ground terminal block 45 are mounted to a module 8 with screws, on a single module heater 7. Block 44 is normally mounted at chamber 70 on a double module (8) heater (7) and would be mounted at chamber 90. In the same manner, the high limit switch 59 is mounted on the second chamber 70 and 90 of each module 8 of each heater 7.

Figure 12:
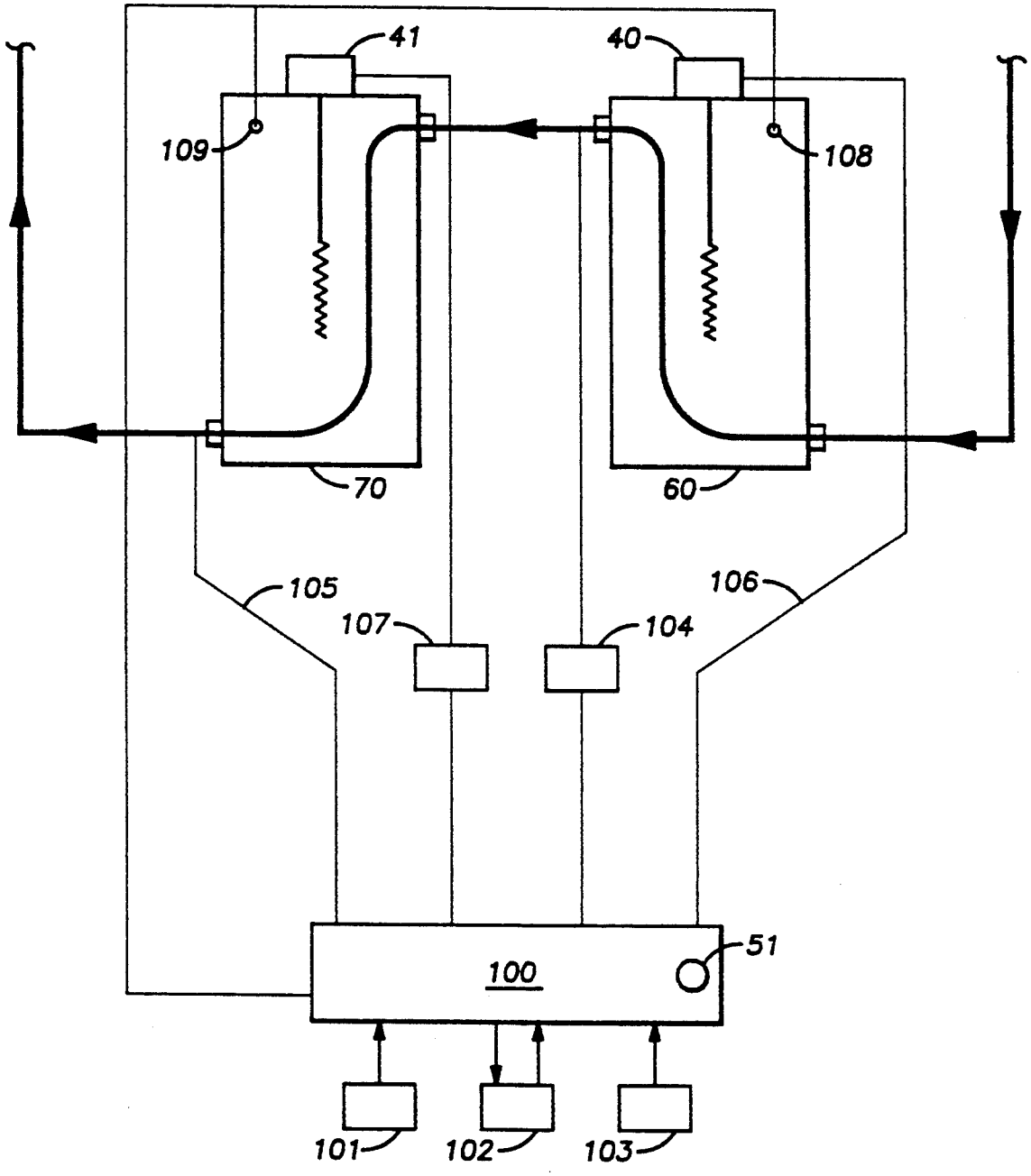
FIG. 12 is a schematic control diagram of the control system logic.

FIG. 12 is a flow diagram showing the path of water flow and related schematic electricals. FIG. 13, however, shows in greater detail a description of the control system of the water/fluid heater. A conventional power supply (PS) which may supply 240 volts incoming current to the control board 50 is reduced to 10 volts AC by means of a transformer (T1). A rectifier (B1) furnishes 10 volts DC which is used to fire the optitriacs U51, U61, U71 and U81, and a voltage regulator (U) then furnishes 5 volts DC which is used for the logic system of control board 50.

MEANS FOR CONTROLLING THE ENERGIZING AND DE-ENERGIZING OF THE HEATING ELEMENTS

Figure 13B:
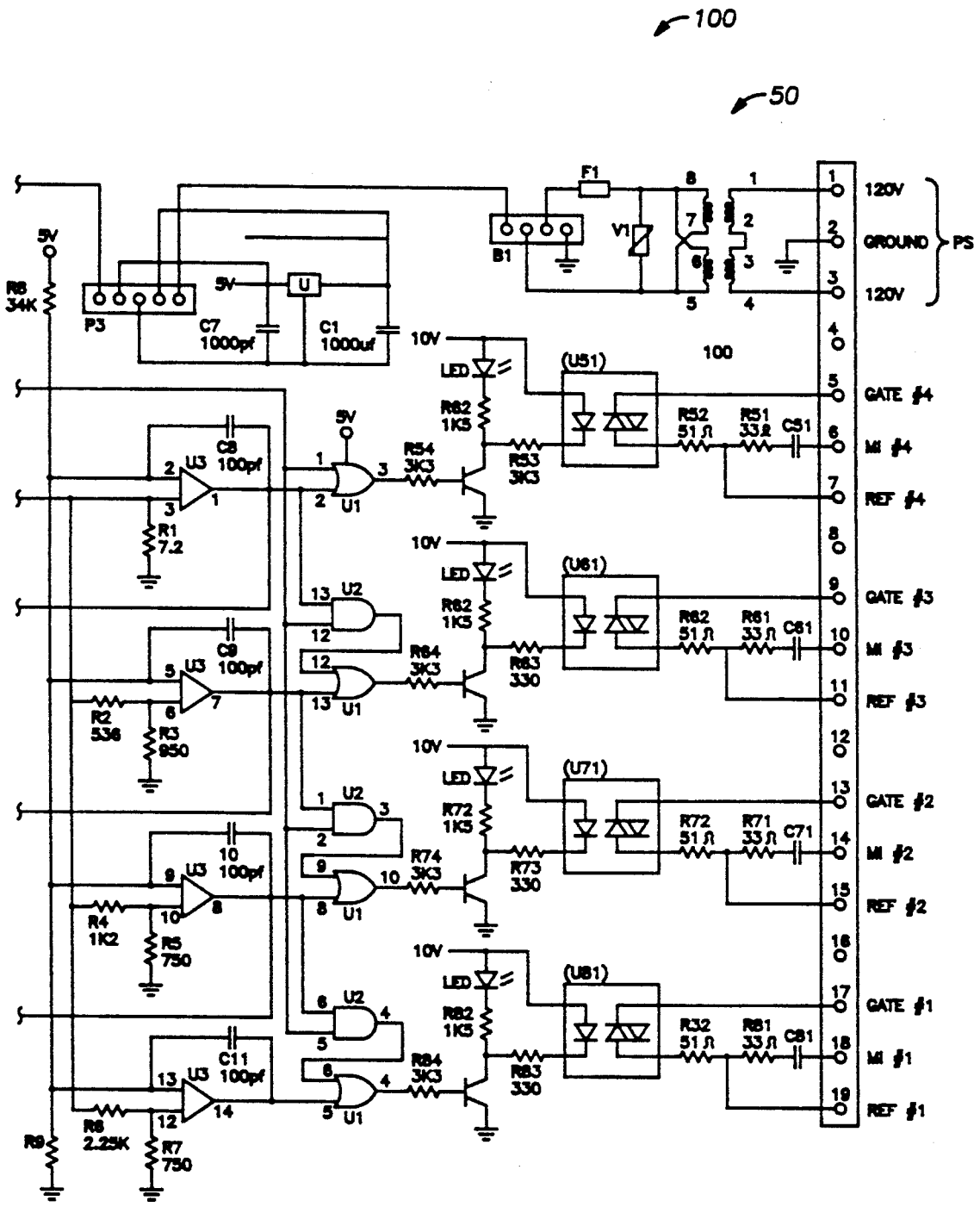
FIGS. 13A and 13B are schematic control diagrams of the heater control system.
Figure 13A:
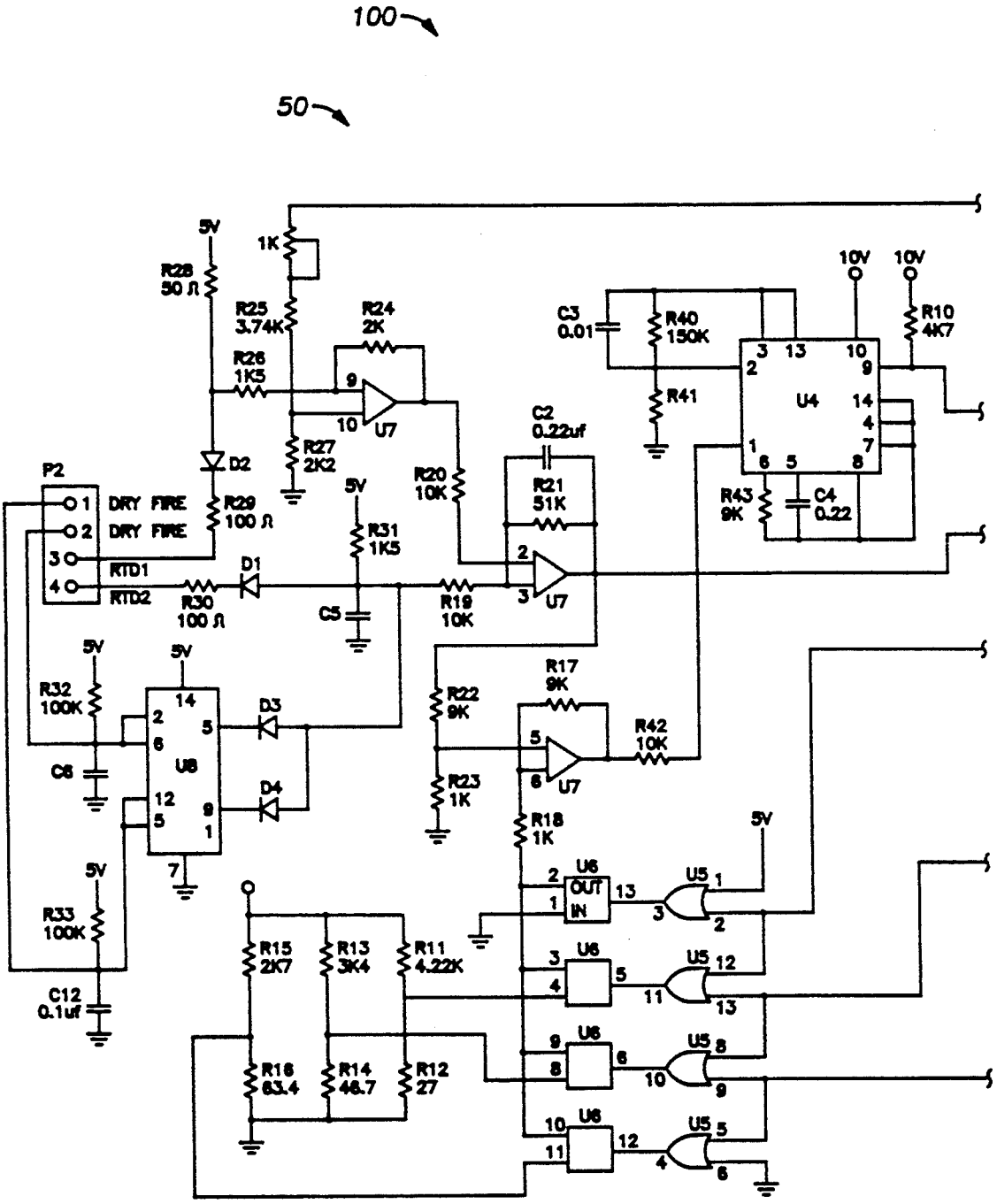

As best shown in FIGS. 1, 8 and 10, there are two temperature sensors 55 and 56 which are connected to terminals 3 and 4 at connector (P2) (see FIG. 13B). The sensors provide comparison voltage input with Set Point voltage furnished by potentiometer 51. The voltage input from first temperature sensor (55) goes to the operational amplifier U7 through terminals 9 and 10. The signal that leaves the amplifier U7, "if" the temperature sensor 55 is lower than the Set Point Temperature of potentiometer 51, will fire the logic to energize the heating elements 40, 41 (FIG. 1). The second temperature sensor 56 detects the temperature of the fluid at the last chamber 70 of the heater (FIG. 1) and compares the reference voltage after sensor 55 ascertains the change in temperature. Once it determines the voltage change, it fires the voltage coming from the operational amplifier U3 to fire the modulator U4 which gives a pulsating output through terminal 9. If the voltage comes close to being equal, the output will stop. The modulated output goes through the "doors" at U1 firing optitriacs U51, U61, U71 and U81 in a modulating manner. If the temperature or voltage coming from temperature sensor 56 is lower than the "firing" voltage, then the logic will compare this difference in steps given by the voltage reference of Integrated Circuits U5 and U6 (FIG. 13A) firing in sequence, comparing those voltages with amplifier U3 which gave the output to the optitriacs U51, U61, U71 and U81, firing the elements in sequence. In this manner, it will have a proportional and modulated output to the heating elements 40 and 41.

If the water temperature (FIGS. 12 and 13A and 13B) is lower than the predetermined temperature (potentiometer 51), all of the heating elements 40 and 41 will be energized. In the case of a four chamber unit (see FIG. 10), the No. 4 heating element 43 will begin modulating until it finally shuts down (when temperature setting is satisfied). Otherwise, the temperature continues to rise, and the third heating element 42 will start modulating until it finally shuts off. The second heating element 41 and first heating element 40 will also do the same, i.e., they will start modulating until they finally shut down as the temperature reaches the set point.

If the temperature is lower than the predetermined (i.e., Set Point Temperature) (see 103, FIG. 12), the first heating element 40 will energize in a modulating manner until it stays fully on. If the temperature continues to fall, then the second heating element 41 will be energized and start modulating also until it stays fully on. If the temperature still continues to fall, then the third heating element 42 and the fourth heating element 43 will do the same. As they are energized, they will start modulating until they stay fully on.

Referring to FIG. 12, the logic system has two circuits 108 and 109 to protect against dry firing, i.e., when no water is in the chambers. This may not unusually occur due to shut down of the water supply system itself, or new installations or repairs where the water supply has never been turned on or it has been turned off temporarily. These logic circuits, called dry fire circuits, are created by liquid level sensors on terminals 1 and 2 in connector (P2) (see FIG. 13A). In FIGS. 1, 8 and 10, one may see liquid level sensors 57 and 58 which are to be located as high as possible in the first and last chambers of each module. They trigger the integrated circuit U8 (FIG. 13) which shuts off the logic over OPAMP U3. In the "firing" input (see FIG. 13A), voltage goes to "0", preventing heater from coming on in the even that "no" water is sensed by the liquid level sensors 1 and 2 of P2.

The operation of this heating system requires that enough heat be applied in the first chamber 60 (FIG. 1 ), in order to maintain that chamber water temperature at or above initial set temperature. This control system uses in this example, a first temperature sensor 55 located in the first chamber 60 to measure temperature, while the second temperature sensor 56 located in the second chamber 70 is used to measure the temperature there, thus establishing a temperature difference between the chambers one and two.

When there is no water flow, heat is added to water in the first chamber 60 by heater element 40 in order to maintain water temperature at or above the initial set temperature, thereby maintaining the temperature higher than the second chamber 70 temperature. When the first chamber temperature tends to drift and approaches the temperature in the second chamber, which is monitored by the second temperature sensor 56, the control system evaluates the reading as a "flow" condition. This condition is only momentary for as the first heating element 40 is energized, the temperature increases quickly since there is no "real flow" and the value of the first chamber temperature becomes higher than the second chamber temperature.

The control system again evaluates this temperature difference between the chambers and determines there is no flow and the initial set temperature point is restored.

The foregoing disclosure and description of the invention are illustrative and explanatory thereof, and various changes in the size, shape and materials used, as well as the details of the illustrated construction, including improvements, may be made without departing from the spirit of the invention and are contemplated as following within the scope of the appended claims.

What is claimed:

1. A heater apparatus designed for heating of a continuous flow of fluids therethrough comprising one or more modules disposed in serial fashion, each of said modules constituting a modular apparatus comprising:

(a) a first chamber and a second chamber each for the receipt of a flow of fluid therethrough and wherein the flow of fluid enters the first chamber at one end and exits it at the other end whereupon it enters the second chamber at one end and exits at the other end;

(b) a first temperature sensing means operably disposed in the first chamber for measuring the temperature of fluid therethrough and a second temperature sensing means operably disposed in the second chamber for measuring the temperature of the flow of fluid therethrough, and a means for comparing the temperature of fluid flow in the first chamber against the temperature of fluid flow in the second chamber;

(c) a heating element disposed in each of said chambers operably connected to said first and second temperature sensing means for measuring the temperature of the flow of fluid through each said first and second chamber and to said means for comparing the differences in temperature of fluid flow therein;

(d) a means for energizing each of said heating elements selectively;

(e) a temperature set means operatively connected to each of said heating elements for the separate actuation thereof;

(f) an electronic means coupling each said temperature measuring means to said temperature set means so that each of said heating elements are selectively energized when the temperature of the flow of fluid in either of the chambers is lower than the temperature set means; and (g) said the means for energizing the heating elements comprises means for energizing the heating element immediately proximate to the fluid entering the first module when the temperature of the fluid is below that which is desired and wherein said means for energizing said heating element proximate to the entering fluid in the last module continues to heat the fluid until a preset predetermined temperature is reached.

2. The heater apparatus of claim 1, wherein the number of said modules is determined by the predicted volume of fluid flow such that a larger quantitative fluid flow requires a heater apparatus having more modules than a predicted lower volume of fluid flow, each of said modules connected serially to the preceding modules and wherein each of said modules comprises first and second chambers having heating elements therein operably connected to temperature sensing and energizing means.

3. The heater apparatus of claim 2, wherein at least one of said chambers is characterized by venting means for releasing entrapped air or gases there within.

4. The heater apparatus of claim 3, wherein each of said chambers is characterized by an interior epoxy coating for minimizing deterioration therein resulting from contact with the fluid and an exterior coating for reducing the loss of heat from within said chambers and thereby enhancing the impermeable character of the module.

5. The heater apparatus of claim 4, in which at least one of said chambers is characterized by a drain mans in the bottom thereof which includes a removable plug for facilitating cleansing of the interior chamber.

6. A heating apparatus for heating a flow of fluid while it continuously travels therethrough having one or more modules, and wherein each of said modules are characterized by a first and second chamber, and wherein each of said chambers having a heating means disposed therein, the improvement comprising:

(a) an electronic control means operatively coupled to each said heating means in each chamber and to a temperature sensing means disposed at the entry to the first chamber and at the exit of the heating apparatus so as to sense the temperature of the fluid passing thereby at each location and for energizing each of said heating means selectively when the temperature of the fluid at the entry to the first chamber is less than a predetermined temperature or for energizing the heating means near the exit of the heating apparatus when the temperature of the fluid is less than the predetermined temperature.

7. The heater apparatus of claim 6, wherein a flow volume detection means is operatively connected to the heater apparatus for measuring the fluid volume flow therethrough and including a temperature sensor means located at each of two positions in the heater apparatus for detecting a differential in temperature therebetween to thereby ascertain the existence of flow within the apparatus.

8. The heater apparatus of claim 6 wherein the heater apparatus includes a temperature sensing means to detect the temperature of fluid departing from each chamber, and wherein the temperature sensing means is operatively coupled to a temperature set means such that the temperature sensing means energizes the heating means in the departing chamber until the fluid departing the last chamber reaches a temperature equivalent to the temperature required by the temperature set means.

9. A heater apparatus designed for heating of a continuous flow of fluids therethrough comprising one or more modules disposed in serial fashion, each of said modules constituting a modular apparatus comprising:

(a) a first chamber and a second chamber each for the receipt of a flow of fluid therethrough and wherein the flow of fluid enters the first chamber at one end and exits it at the other end whereupon it enters the second chamber at one end and exits at the other end;

(b) a first temperature sensing means operably disposed in the first chamber for measuring the temperature of fluid therethrough and a second temperature sensing means operably disposed in the second chamber for measuring the temperature of the flow of fluid therethrough, and a means for comparing the temperature of fluid flow in the first chamber against the temperature of fluid flow in the second chamber;

(c) a heating element disposed in each of said chambers operably connected to said first and second temperature sensing means for measuring the temperature of the flow of fluid through each said first and second chamber and to said means for comparing the differences in temperature of fluid flow therein;

(d) a means for energizing each of said heating elements selectively;

(e) a temperature set means operatively connected to each of said heating elements for the separate actuation thereof;

(f) an electronic means coupling each said temperature measuring means to said temperature set means so that each of said heating elements are selectively energized when the temperature of the flow of fluid in either of the chambers is lower than the temperature set means; and (g) said means for energizing the heating elements comprises means for energizing the heating element immediately proximate to the fluid departing the last module when the temperature of the fluid is below that which is desired and wherein said means for energizing said heating element immediately proximate to the departing fluid in the last module continues to heat the fluid until a preset predetermined temperature is reached.

10. The heater apparatus of claim 9, wherein the number of said modules is determined by the predicted volume of fluid flow such that a larger quantitative fluid flow requires a heater apparatus having more modules than a predicted lower volume of fluid flow, each of said modules connected serially to the preceding modules and wherein each of said modules comprises first and second chambers having heating elements therein operably connected to temperature sensing and energizing means.

11. The heater apparatus of claim 10, wherein at least one of said chambers is characterized by venting means for releasing entrapped air or gases there within.

12. The heater apparatus of claim 11, wherein each of said chambers is characterized by an interior epoxy coating for minimizing deterioration therein resulting form contact with the fluid and an exterior coating for reducing the loss of heat from within said chambers and thereby enhancing the impermeable character of the module.

13. The heater apparatus of claim 12, in which at least one of said chambers is characterized by a drain means in the bottom thereof which includes a removable plug for facilitating cleansing of the interior chamber.

* * * * *